US009285132B2

(12) United States Patent
Waulters

(10) Patent No.: US 9,285,132 B2
(45) Date of Patent: Mar. 15, 2016

(54) PORTABLE SAW ENCLOSURE FEATURING MOISTURE AND DEBRIS LADEN AIR EXTRACTION PLUS ELECTRICAL CONTROL PANEL

(71) Applicant: Frank Edward Waulters, Sun City, CA (US)

(72) Inventor: Frank Edward Waulters, Sun City, CA (US)

(73) Assignee: Frank E Waulters, Hemet, CA (US)

( * ) Notice: Subject to any disclaimer, the term of this patent is extended or adjusted under 35 U.S.C. 154(b) by 226 days.

(21) Appl. No.: 13/986,108

(22) Filed: Apr. 3, 2013

(65) Prior Publication Data

US 2013/0303066 A1 Nov. 14, 2013

Related U.S. Application Data

(60) Provisional application No. 61/687,838, filed on May 2, 2012.

(51) Int. Cl.

| | |
|---|---|
| ***B08B 15/04*** | (2006.01) |
| ***F24F 7/007*** | (2006.01) |
| ***B08B 15/02*** | (2006.01) |
| ***E04H 1/12*** | (2006.01) |

(52) U.S. Cl.

CPC ..... *F24F 7/007* (2013.01); *B08B 15/02* (2013.01); *E04H 1/1277* (2013.01)

(58) Field of Classification Search

CPC ..... B08B 15/00; B08B 15/007; B08B 15/04; F24F 7/007

USPC ..... 4/526–528, 599, 600; 135/116, 212, 135/904; 483/3; 454/49, 50, 56, 60, 63, 64, 454/65, 904

See application file for complete search history.

(56) References Cited

U.S. PATENT DOCUMENTS

| | | | | |
|---|---|---|---|---|
| 2,212,326 | A * | 8/1940 | Piken | 4/558 |
| 3,766,844 | A * | 10/1973 | Donnelly et al. | 454/238 |
| 4,675,923 | A * | 6/1987 | Ashley | 4/599 |
| 4,682,448 | A * | 7/1987 | Healey | 52/63 |
| 4,779,603 | A * | 10/1988 | Crocetti | 125/13.01 |
| 4,928,581 | A * | 5/1990 | Jacobson | 454/340 |
| 4,975,992 | A * | 12/1990 | Patterson et al. | 4/599 |
| 5,062,871 | A * | 11/1991 | Lemon, III | 55/385.2 |
| 5,172,680 | A * | 12/1992 | Swan | 125/12 |
| 5,577,955 | A * | 11/1996 | Voege | 451/455 |
| 5,741,175 | A * | 4/1998 | Voege | 451/455 |
| 6,257,222 | B1 * | 7/2001 | Kaeser | 125/12 |
| 6,557,602 | B1 * | 5/2003 | Sorensen et al. | 144/286.5 |
| 6,796,890 | B1 * | 9/2004 | Goldrick | 451/454 |
| 7,134,444 | B2 * | 11/2006 | Mintie et al. | 135/131 |
| 7,448,945 | B2 * | 11/2008 | Bessent | 454/63 |
| 7,635,293 | B2 * | 12/2009 | Sun et al. | 451/354 |
| 7,766,728 | B2 * | 8/2010 | Williamson et al. | 451/451 |
| 2010/0035738 | A1 * | 2/2010 | Smith, Jr. | 483/3 |

* cited by examiner

*Primary Examiner* — William Gilbert

(57) ABSTRACT

A saw enclosure having a waterproof metal base pan, with integral receiver brackets for supporting enclosure frame work, and a built in shop-vac attachment port for using a vacuum to produce negative air pressure within enclosure; removing dust, moisture and particulate laden air. The saw enclosure framework assembly includes an electric control panel comprising of a switch controlled, duplex, GFCI outlet, for simultaneously energizing the saw and vacuum, and a continuously powered duplex outlet for powering a jig saw, grinder, drill, light, or any other electrical item. The enclosure, a seamed and fitted cover of flexible fabric or plastic, includes weights or magnets to ensure a tight fit at the base pan. All components disassemble quickly, and fit within base pan, which has a detachable cover for ease of transport.

1 Claim, 8 Drawing Sheets

Figure 1:
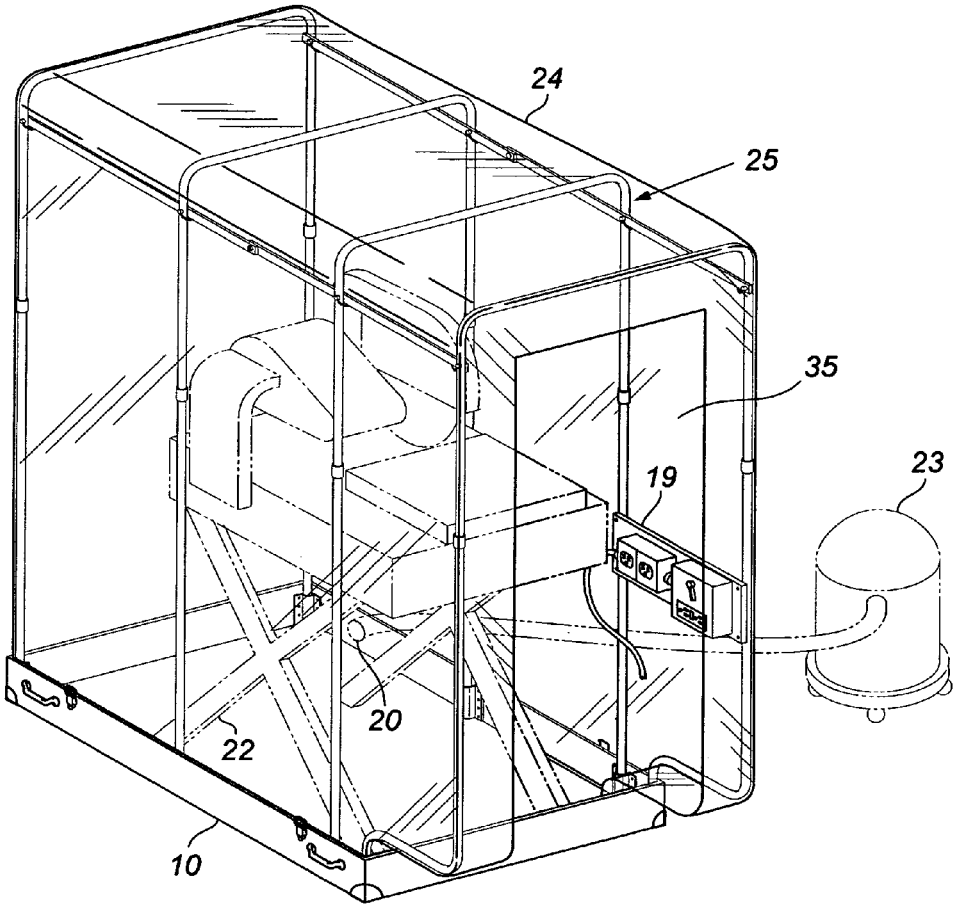

PORTABLE SAW ENCLOSURE FEATURING MOISTURE AND DEBRIS LADEN AIR EXTRACTION PLUS ELECTRICAL CONTROL PANEL

FIELD OF THE INVENTION

The invention relates to tile saws and flooring saws used by contractors and laypeople who install tile, brick, wood or laminate floor, wall and countertop covering. Many patents have addressed the containment of water splash and control of heavy particulate matter, but none the control of fine mist or contaminated air which is propelled by the saw blade and the cooling fan, located within the saw motor; which is then allowed to escape into the surrounding atmosphere and precipitate therefrom in the form of dust that is unhealthful and unsightly.

DESCRIPTION OF PRIOR ART

Shields, enclosures, canopies and shrouds all take the very similar approach of deflecting propelled matter to a collection pan or tray, relying on gravity to do the work of removing mist and debris from the air within these previous inventions, as demonstrated by U.S. Pat. Nos. 7,766,728; 6,796,890; 7,635,293; 6,557,602; 6,257,222; 5,741,175; 5,577,955; 5,457,915; 5,172,680; 4,928,581; 4,779,603; Pub No.: US 2010/0035738. None of the known art addresses the control or removal of smaller airborne particulate matter and moisture which will precipitate at greater distances from the sawing operation, well beyond the confines or stated scope of all known prior art.

SUMMARY OF THE INVENTION

The invention presented, combining the features of portability, self-storing, positive evacuation of contaminated air, electrical control panel and commercial use durability, set this invention apart from any other.

Portability, Self-storing: The present invention completely disassembles and stores in the base pan; equipped with handles, and removable lid to allow for quick assembly, disassembly, transport or storing.

Positive Air Evacuation: Moisture and dust contaminated air is not allowed to escape into surrounding atmosphere. A wet-dry shop-vac connected to the vacuum port in the base pan provides the suction to maintain a negative air pressure within the saw enclosure to prevent small airborne particles from escaping the confines of the saw enclosure.

Electrical Control Panel: Comprising a mounting panel on which is mounted a two gang wet location box with a cover that incorporates a single pole switch and a duplex GFCI outlet which is controlled by aforementioned switch, providing simultaneous electrical power to saw and vacuum, whose onboard switches are always in the on position. Also mounted on the electrical control panel is a wet location single gang box, with a duplex outlet that is always energized, to use for hand held power tools, such as a small angle grinder, sabre saw or portable light.

Commercial Use Durability: Durability is achieved through use of heavy duty materials, such as a metal base pan, semi-rigid structural enclosure framework and a enclosure cover made of heavy gauge reinforced plastic. Simple design features make parts replacement quick and simple.

LIST OF FIGURES

FIG. 1: Perspective view of saw enclosure
FIG. 2: Perspective view of structural frame members, base pan and electrical control panel
FIG. 3: Exploded view of FIG. 2
FIG. 4: Longitudinal section of enclosure
FIG. 5: Plan view of base pan with receiving brackets and magnet locations with handles and latches
FIG. 6: Perspective detail of plastic enclosure cover with magnets and base pan with structural frame receiver brackets
FIG. 7: Perspective detail of electrical control panel
FIG. 8A: Elevation view of base pan side-wall receiving bracket for structural frame
FIG. 8B: Plan view of base pan side-wall receiving bracket for structural frame
FIG. 9A: Elevation view of base pan corner receiving bracket
FIG. 9B: Plan view of base pan corner receiving bracket
FIG. 10: Perspective view of base pan with disassembled structural frame members and lid
FIG. 11: Front view of saw enclosure showing operator access

LIST OF REFERENCE ITEMS

Note: First embodiment of each item represents the inventors preferred embodiment.

ITEM 10. Base Pan:

Made of galvanized steel sheet metal, bent to form a box. Corners are overlapped with a sealer-adhesive applied between overlap then riveted in place. Base pan can also be made of other metals or formed plastic such as ABS, PVC, FRP, and others. This item is intended to be sized as a floor model, as shown in FIG. 1—Item 10, or in other sizes for use on a support stand and sized for various saws.

ITEM 11, 12, 14 Support Frame Sections:

Made of bent plastic tubing, bent and sized in sections that will store inside base pan (item 10), when disassembled. Swaged ends could be substituted for item 13 couplings. Alternate material for support frame could be metal.

ITEM 13. Couplings or Swaged Ends:

When couplings are used, one end of coupling is fixed in place. Couplings or swaged ends of tubing accommodate rapid assembly and disassembly of support frame sections.

ITEM 15. Spreader Bar:

Made of flat metal bar in two pieces with pivot bolt allowing bar to be folded, thereby fitting into base pan for storage. Spreader bar holds frame members incorrect alignment through use of snap pins, (item 16) in holes in bar and frame.

ITEM 16. Snap Pins:

Commonly found at hardware suppliers. Bolts or other fasteners could be used in place of snap pins. These are used to hold spreader bar (item 15) in place and also item 19 electrical control panel.

ITEM 17. Pivot Bolt:

Pivot bolt is used to facilitate folding of spreader bar (item 15), allowing for spreader bar to be stored in base pan (item 10).

ITEM 18. Side Wall Receiver Bracket:

Made of stamped or formed sheet metal or other material. Shaped to receive support frame tubes and equipped with holes for rivets used for attaching to base pan (item 10). Could also be made of molded plastic.

ITEM 19. Electrical Control Panel Assembly:

Comprised of a metal back panel of galvanized sheet metal with mount holes for affixing to support frame with snap pins or bolts. A two gang wet location electrical box with cover, comprising a switch controlling a duplex GFCI outlet. The switch controls the GFCI outlet thereby giving simultaneous control of the units plugged into said outlet, intended to be a saw and a shop-vac. On the panel is also located a single duplex outlet which is wired to be always energized and intended to provide power for a light, angle grinder, drill motor, or other power tool. Also included is power cord used to energize entire control panel.

ITEM 20. Vacuum Hose Attachment Port:

A circular hole in base pan side, near rear of pan, providing a properly located port for optimum effect in removing contaminated air from enclosure into shop vac filter.

ITEM 21. Corner Receiver Bracket

Same as item 18 except bracket ears are bent to fit inside corner of base pan (item 10).

ITEM 22. Saw:

Tile or brick, wet or dry saw, also flooring saw. Any portable configuration of these saws will work very well in this enclosure, thereby allowing saws to be used in finished spaces without risk of causing moisture or dust laden air to precipitate onto finished surfaces.

ITEM 23. Shop-vac

A portable wet-dry vacuum cleaner of the larger variety equipped with a large diameter hose for connection to vacuum port (item 20).

ITEM 24. Plastic Cover. (Enclosure Cover):

Plastic scrim, multi layered reinforced flexible material. Fitted and seamed to snugly fit enclosure frame. Transparent and durable, scrim is seamed by means of hot melt glue, permanent sealing tape, plastic welding, using heat or chemicals or other methods including sewing. Cover can be made of many types of flexible fabric.

ITEM 25. Entire Structural Frame Assembly.

ITEM 26. Magnets:

Strip magnets or other type installed into pockets at bottom edge of enclosure cover around entire perimeter. These magnets provide a seal at bottom of cover where cover meets inside of base pan, aiding the vacuum effect which is critical to function of saw enclosure.

ITEM 27. Pocket in Plastic Cover for Magnets:

Installing magnets in pocket keeps magnets in desired location and protects magnets from moisture and debris.

ITEM 28. Seam Where Plastic Joins to Form Pockets: See FIG. 6 for location of seam in relation to cover bottom.

Figure 6:
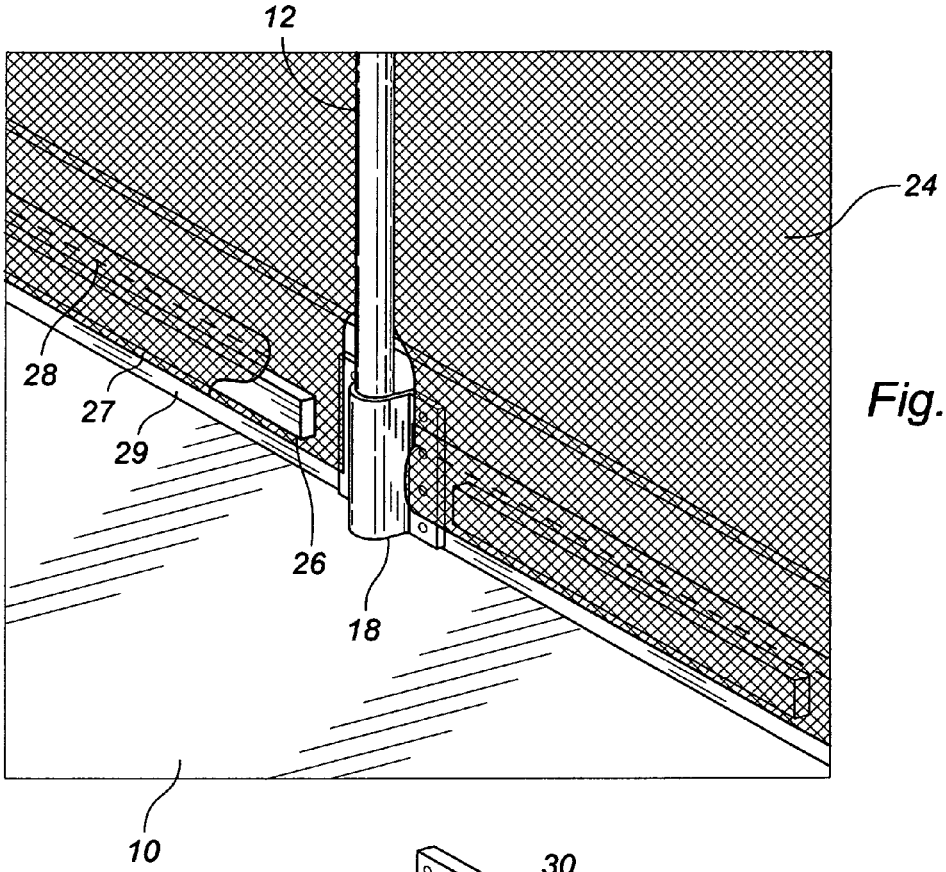

ITEM 29. Side Wall of Base Pan:

See FIG. 6 for detail drawing.

ITEM 30, 31, 32: Hot Duplex Outlet, Duplex Outlet GFCI-Switch Controlled, On/Off Switch for Control of Item 31. See FIG. 7. These items are explained in detailed breakdown of item 19.

ITEM 33. Holes in Receiver Brackets:

These holes are for rivets or bolts that fasten brackets to base pan. See FIGS. 8 and 9.

ITEM 34. Space for Receiving Frame:

Lower support frame member is inserted in this space. See FIGS. 8 and 9.

ITEM 35. Opening in Cover:

This opening is where operator stands. ITEM 36, 37. Two Part Latch:

This two part latch is installed to hold base pan cover in place. Commonly found at most hardware suppliers.

ITEM 38. Overhangs of Plastic Cover

These overhangs reduce the overall size of the opening where operator stands, increasing the vacuum efficiency.

ITEM 39. Base Pan Lid:

Made of sheet metal or other semi rigid material and when affixed with afore described two part latch holds all the parts of the enclosure described in this patent.

ITEM 40. Base Pan Corner Protectors:

Metal corner protectors applied with adhesive prevent corner leaks caused by rough handling. Commonly found at hardware suppliers.

ITEM 41. Base Pan Handle:

Used to aid in handling and transport. Many types available through hardware suppliers.

DETAILED DESCRIPTION OF THE PREFERRED EMBODIMENT(S)

An enclosure and method for containment of and removal of particulate matter from air contaminated by saw operations within enclosure before returning said air to ambient. The removal of contaminants is accomplished through use of wet-dry filter installed in wet-dry vacuum cleaner, Item 23. FIG. 1 attached to saw enclosure vacuum port Item 20. System as depicted in attached drawings is hereby described in detail.

Figure 2:
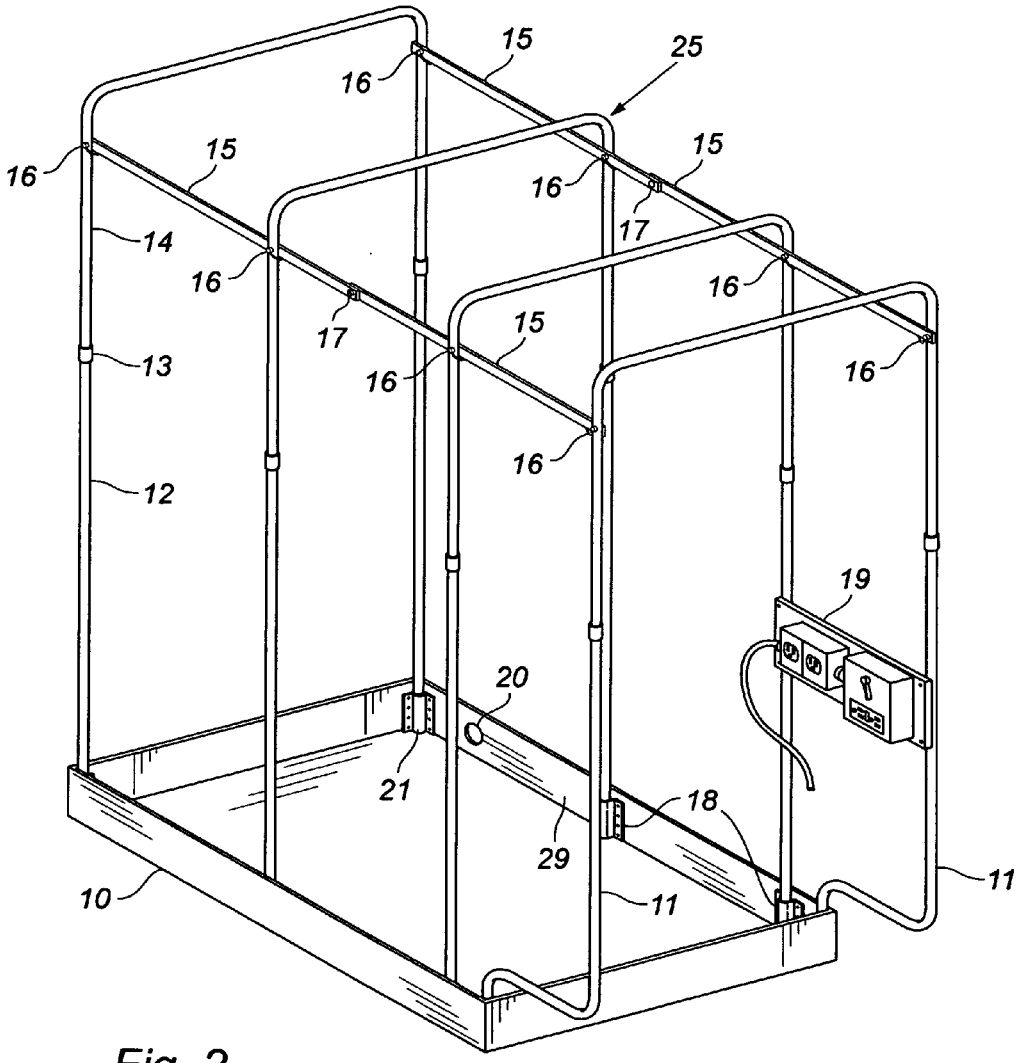
Figure 3:
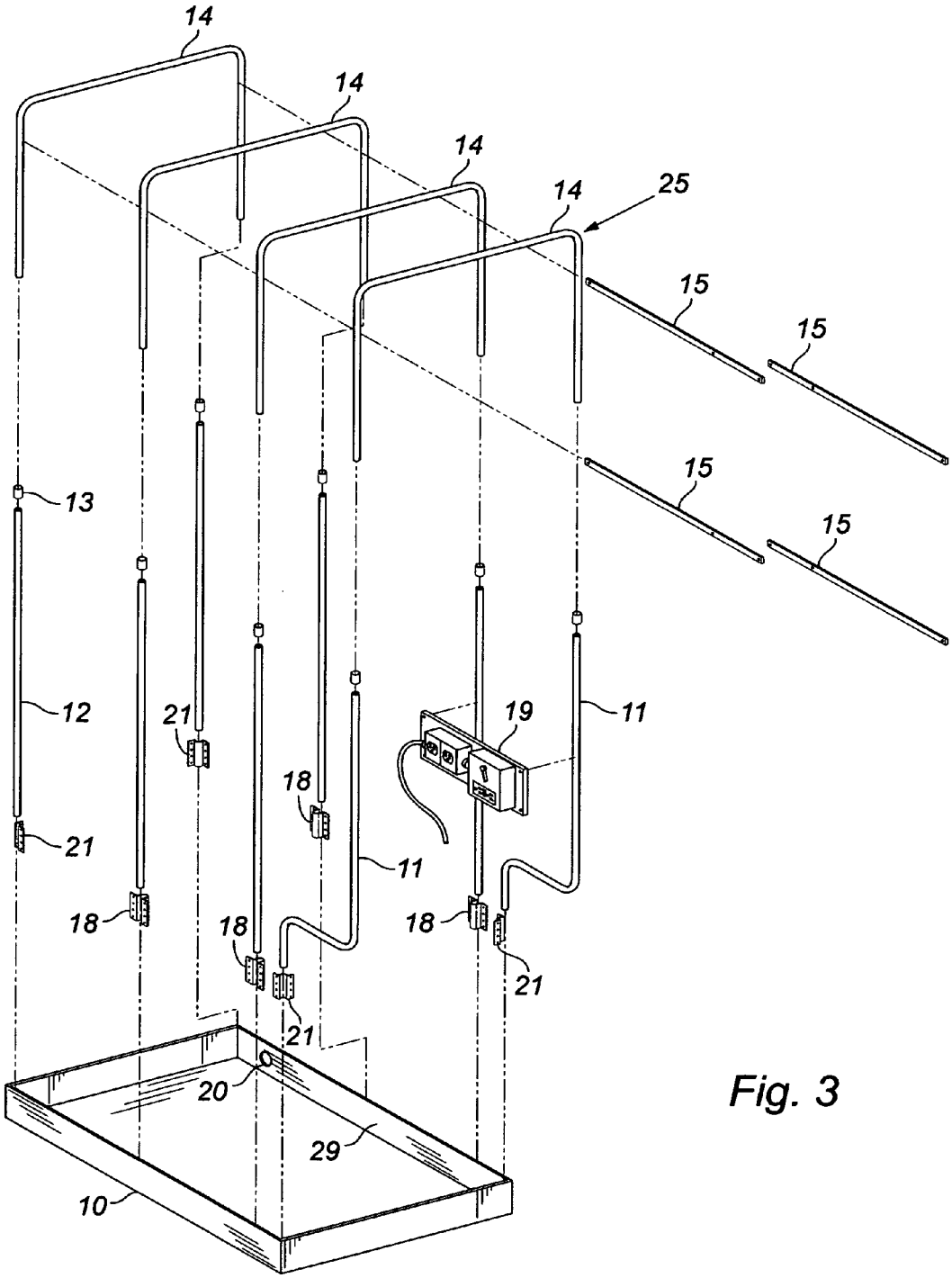
Figure 4:
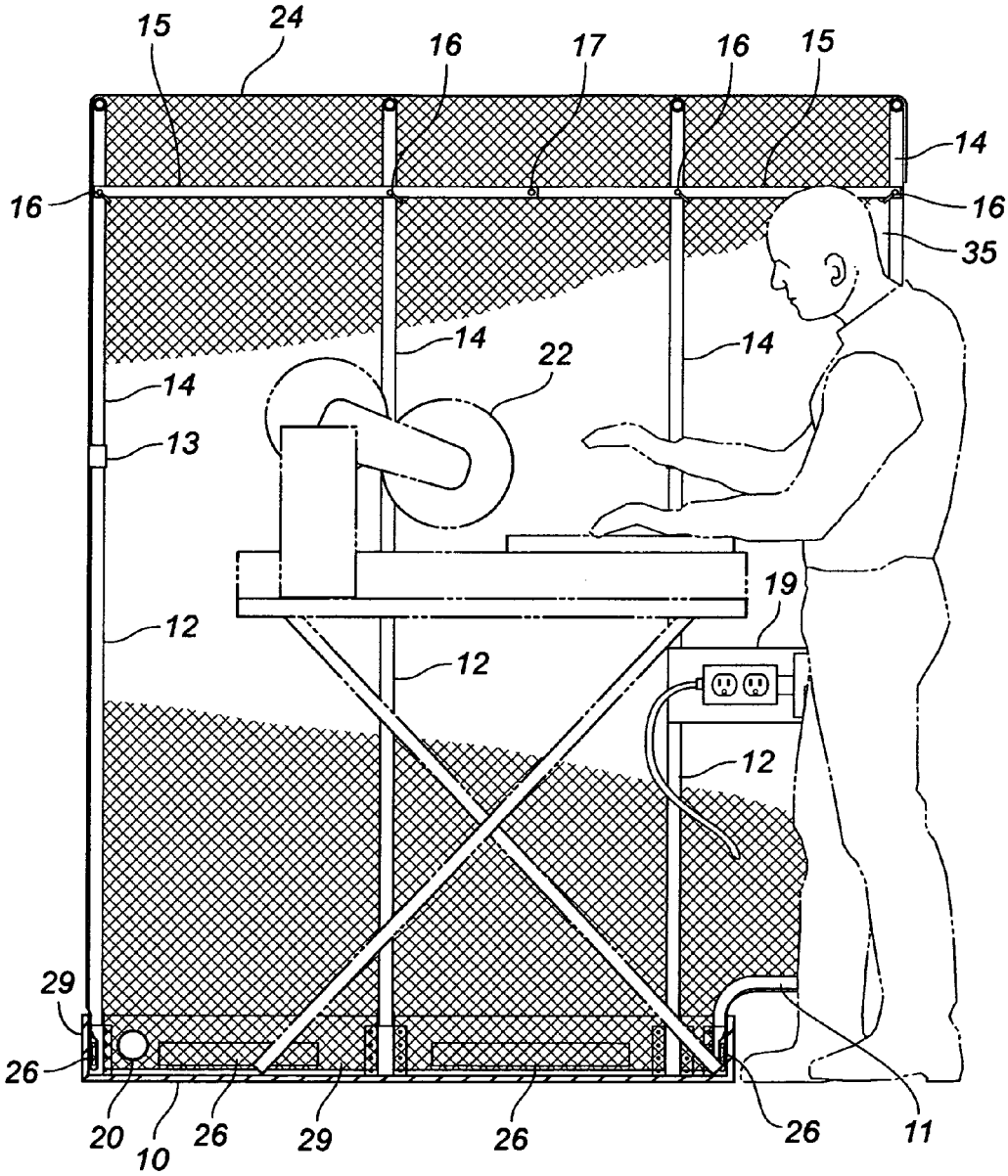
Figure 5:
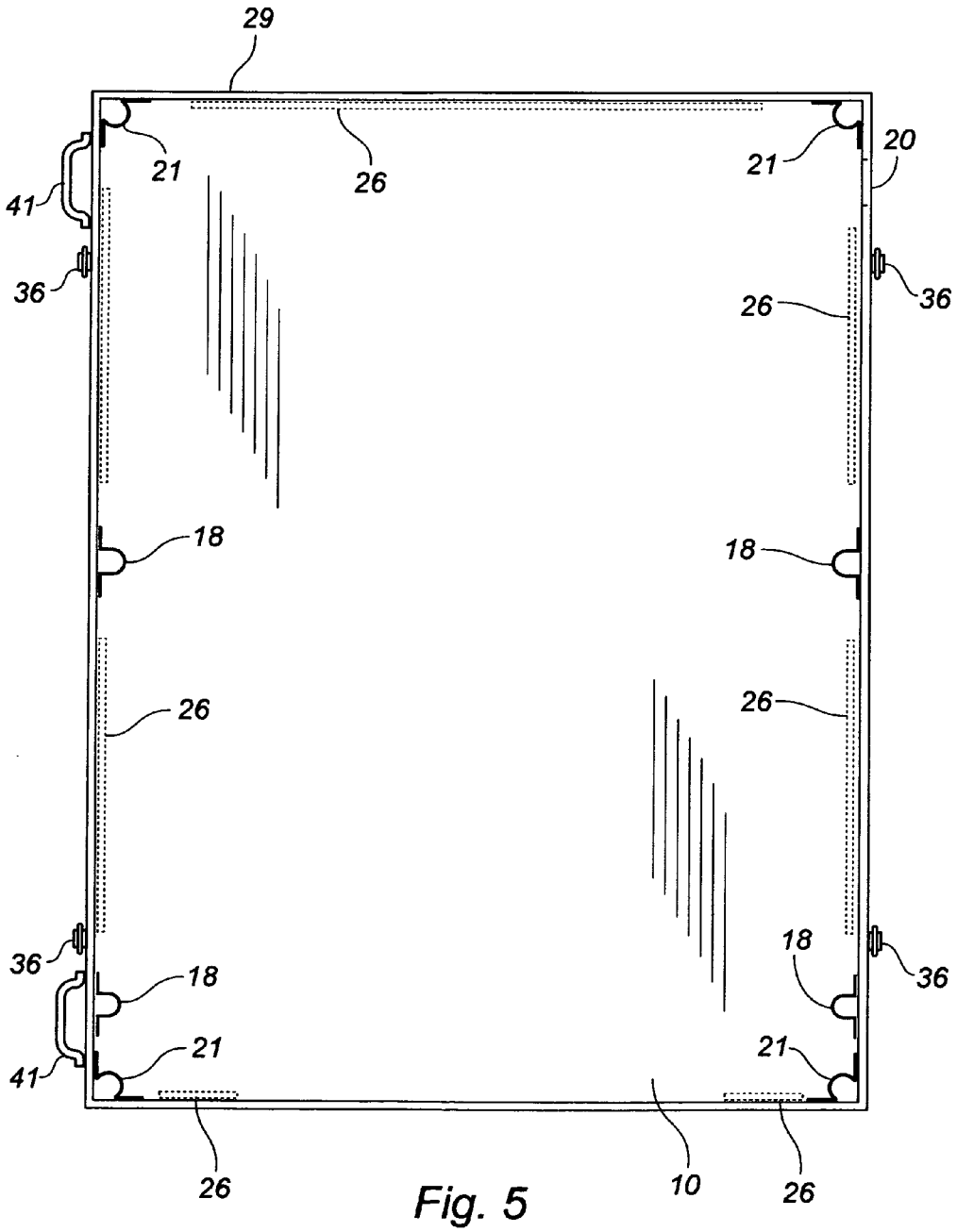
Figure 7:
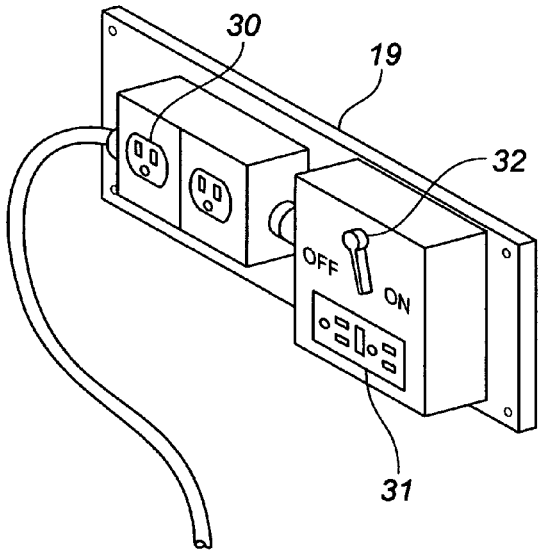
Figure 8A:
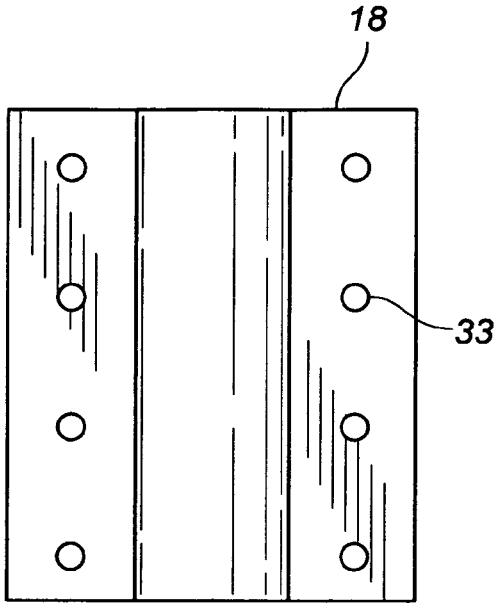
Figure 9A:
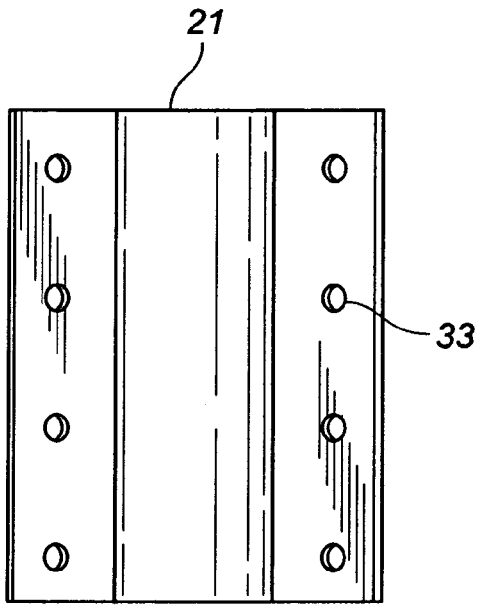
Figure 8B:
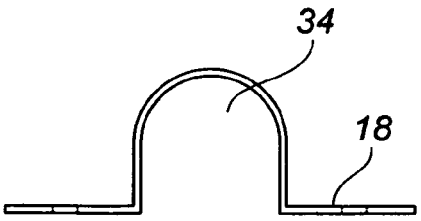
Figure 9B:
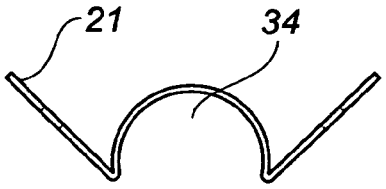
Figure 10:
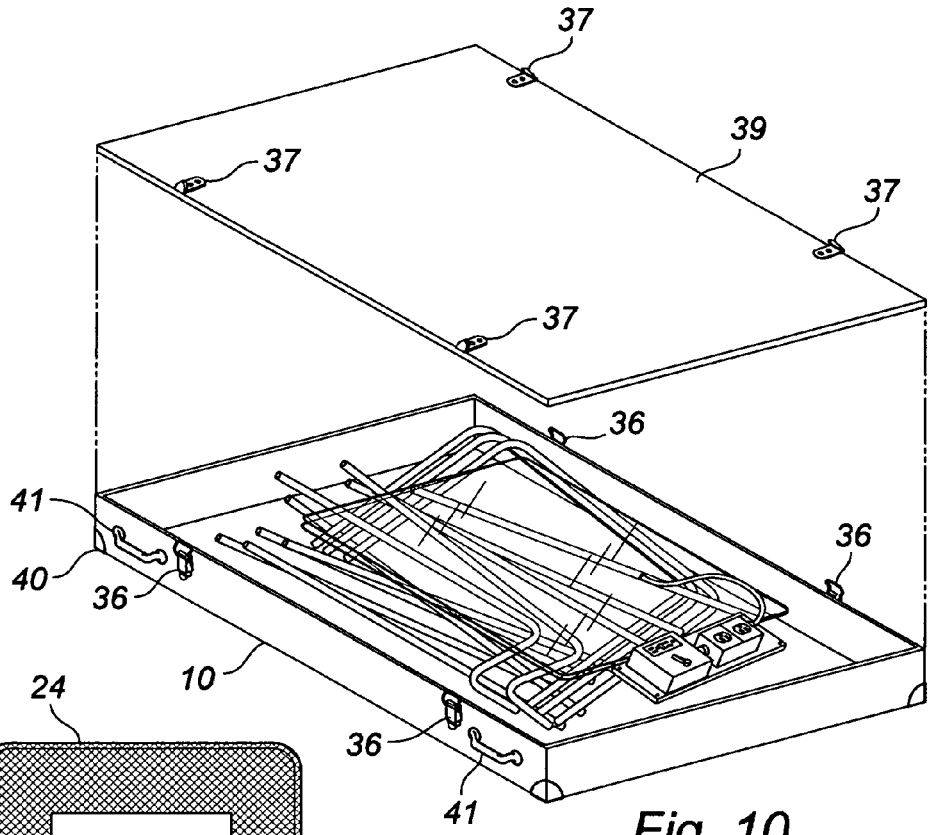
Figure 11:
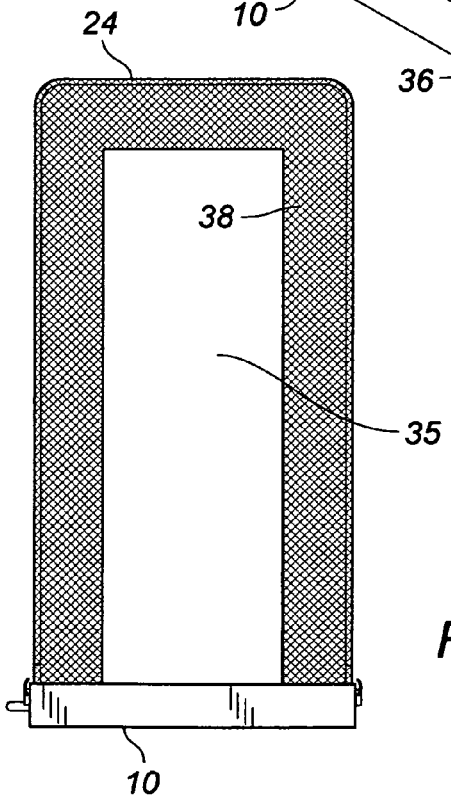

FIG. 1 depicts the saw enclosure system, including a saw, Item 22, and the required wet-dry vacuum, Item 23, connected to vacuum port, Item 20. Also shown in FIG. 1 is waterproof base pan, Item 10, supporting the enclosure framework ribs, Item 25, which in turn support the electrical panel, Item 19, which provides for simultaneous switching of saw and vacuum and plastic scrim enclosure cover, Item 24. FIG. 2 depicts enclosure with cover, Item 24, removed. Waterproof base pan, Item 10, is made of galvanized sheet metal in embodiment shown with corners of said waterproof base pan overlapped and sealed with rivets and sealer adhesive. Item 25, the enclosure framework is made of bent plastic tubing in embodiment shown and is separable at couplings, Item 13, allowing for storage in base pan. The enclosure lower framework vertical members, Items 11 and 12, are inserted into support brackets, Items 18 and 21, which are permanently mounted to the base pan vertical sides, Item 29. Item 11, FIG. 2,3,4 depicts lower front vertical framework rib members, which are made of plastic tubing in this embodiment, are bent to include a horizontal offset toward front of saw enclosure which provides a defined space for saw operator to stand in allowing operator to more easily reach saw without standing in base pan of enclosure. This offset in the enclosure framework and the resulting placement of the operator in opening, coupled with the obstruction of the operator's body, adds to the maintenance of a negative air pressure, required to maintain proper scavenging air flow through the enclosure. Item 12, FIG. 2,3,4 lower vertical framework rib members are plastic tubing members with couplings fixed to top end and in turn receive upper portion of enclosure ribs, Item 14. Item 13. FIG. 2,3,4 plastic couplings are permanently affixed to upper ends of lower framework rib members, Items 11 and 12 and upper half of plastic couplings are not permanently affixed to upper portion of enclosure framework, Item 14, allowing for storage in waterproof base pan. Items 14 are the upper portions of the enclosure framework ribs that are bent to shape a roof over enclosure through insertion of same into couplings, Item 13. These upper rib sections, Items 14, are made of bent plastic tubing, in this embodiment and are equipped with holes that locate spreader bars with use of snap pins. Items 15,16,17 FIG. 2,3,4, spreader bar assembly, is used to maintain proper spacing of enclosure framework ribs, Item 25. This spreader bar assembly is made of flat metal-bar stock which is fabricated as a centrally foldable unit, facilitated by use of a pivot bolt with Item 17, that will allow folding to fit inside waterproof base pan for storage upon disassembly of enclosure. Spreader bar is assembled to enclosure upper frame with snap pins. Item 19 FIG. 2,3,4,7 electrical control panel assembly comprising a back panel on which is mounted a 2 gang wet location electrical box containing one GFCI duplex outlet, Item 31 FIG. 7, and one single pole switch, Item 32 FIG. 7, which controls the power supply for the GFCI duplex outlet, Item 31 FIG. 7, which in turn supplies switched power to simultaneously control the saw and wet- dry vacuum, whose onboard switches are left in the ON position insuring that saw is not operated without vacuum also running. Also mounted on electrical control panel is a single gang damp location box with a duplex outlet, Item 30 FIG. 7, which is always energized, providing power for the operation of hand held power tools such as an angle grinder or portable light. This electrical control panel is mounted to lower enclosure frame members, Items 11 and 12, with snap pins. Item 20 FIG. 1 through 5 is the wet-dry vacuum attachment port which is located at the optimal point to provide air flow as needed to remove dust and moisture contaminated air from within enclosure before returning said air to ambient through wet-dry vacuum. FIG. 3 is the exploded view of base pan, enclosure framework components and electrical control panel. FIG. 4 is a cutaway view of the saw enclosure showing a tile saw and an operator in relation to the front offset and the convenient location of the electrical control panel. Items not previously described and shown in FIG. 4 are: Item 22 saw, in this embodiment the enclosure is sized for use with various saws. Embodiments of saw enclosure not shown in these drawings are sized for use of enclosure on a stand, saw horses, counter top, etc. and these smaller enclosures are sized primarily for 7" tile saws used in close proximity to work. Item 26 FIG. 4,5,6 magnets, are used to hold plastic enclosure cover tightly to inside of base pan vertical side, Item 29 FIG. 2,3,4,6. FIG. 5 is an overhead view of the base pan showing location of items attached to the base pan and the magnets, Item 26 which are part of the enclosure cover. Item 36 depicts location of latches for enclosure cover, Item 39, FIG. 10. Item 41, are handles, providing for greater ease of handling. FIGS. 6 and 11 Item 24 enclosure cover made of clear multi-layer reinforced plastic flexible material, also known as "scrim", is fitted over enclosure framework ribs with all seams sewn for added durability. Item 26 magnets, segmented, bar, strip or other are sewn into hem pockets Item 27. FIG. 7 is a detail drawing of the electrical control panel with power cord. FIG. 8A and 8B are detail drawings of base pan side wall receiver brackets, Items 18 and 21, that are installed with rivets and used to support enclosure framework— in space indicated as Item 34. FIG. 9A and 9B are detail drawings of corner receiver brackets that support enclosure framework. FIG. 10 depicts all saw enclosure parts stored in base pan and ready for cover Item 39. FIG. 11 showing opening which is sized to help create the negative air pressure when operator is standing in said opening, Item 35, thereby creating the airflow characteristics needed to prevent the contaminated air caused by sawing operations from escaping into the surrounding area through the operator opening.

The invention claimed is:

1. A portable saw enclosure, comprising:

A waterproof base pan, said base pan having a rectangular and substantially planar floor with four perimeter edges, and four side members, a respective one of said side members being attached at a respective said perimeter edge and to respective longitudinal ends of said side members to form a partial enclosure, said attachment at said longitudinal ends of said adjacent sides forming a respective corner connection, and a circular aperture in one of said side members configured to function as a vacuum hose attachment port;

a first plurality of receiving brackets, a respective one of said first receiving brackets being connected at each corner connection of said waterproof base pan; and a second plurality of receiving brackets attached at an interior surface of two of said side members;

a first plurality of substantially identical support frame sections, each said first frame sections having a first end and a second end and being substantially straight, the number of said first support frame sections being equal to two less than the total number of said first and said second plurality of receiving brackets, said first end of said first support frame sections being receivable in a respective one of said first or second receiving brackets;

a second plurality of substantially identical support frame sections, said second support frame sections having a first, a second and a third portion, said second portion being between said first and said third portions, a first end of said second portion is connected to an end of said first portion by a first bend, and a second end of said second portion is connected to said third portion by a second bend, whereby when in the installed position, the respective second and third portions extend outside one of said perimeter edges of said base pan;

a third plurality of substantially identical support frame sections, said third plurality of support frame sections being substantially U-shaped and having a center section having a first and second end and a respective longitudinal member connected at respective ones of said first and second ends and terminating in free distal ends; the free distal ends being connectable to respective second ends of opposing first support frame sections or opposing second frame sections by a respective plurality of couplers;

a plurality of spreader bars being connectable to respective longitudinal ends of said third plurality of support frame sections, said spreader bars maintaining said third plurality of support frame sections in a fixed distance relative to each other in the installed position and being oriented substantially perpendicular to a longitudinal axis of said first support frame sections;

an electrical control panel attached to one of said first and one of said second support frame sections;

a plastic cover dimensioned to enclose said first, said second and said third plurality of support frame sections and said spreader beams, and a plurality of magnets attached to said cover for magnetically attaching said plastic cover to said base pan;

whereby said base pan, said first, second and third plurality of support frame sections, said spreader bars and said plastic cover form said portable saw enclosure;

whereby a totality of said first, said second and said third plurality of support frame sections and said spreader bars are sized so as to fit within said waterproof base pan when said saw enclosure is disassembled.

* * * * *